US010800563B2

(12) United States Patent
Yoshikane

(10) Patent No.: US 10,800,563 B2
(45) Date of Patent: Oct. 13, 2020

(54) GRIPPER DEVICE FOR A BAG FILLING AND PACKAGING MACHINE

(71) Applicant: Toyo Jidoki Co., Ltd., Minato-ku, Tokyo (JP)

(72) Inventor: Tohru Yoshikane, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 328 days.

(21) Appl. No.: 15/793,734

(22) Filed: Oct. 25, 2017

(65) Prior Publication Data

US 2018/0118393 A1 May 3, 2018

(30) Foreign Application Priority Data

Oct. 27, 2016 (JP) ..... 2016-210417

(51) Int. Cl.

| | |
|---|---|
| ***B65B 43/62*** | (2006.01) |
| ***B65B 43/46*** | (2006.01) |
| ***B65B 43/32*** | (2006.01) |
| ***B65B 59/00*** | (2006.01) |
| ***B65B 43/16*** | (2006.01) |
| ***B65B 43/30*** | (2006.01) |

(52) U.S. Cl.

CPC ..... *B65B 43/465* (2013.01); *B65B 43/16* (2013.01); *B65B 43/30* (2013.01); *B65B 43/32* (2013.01); *B65B 43/62* (2013.01); *B65B 59/003* (2019.05); *B65B 59/005* (2013.01)

(58) Field of Classification Search

CPC ..... B65B 43/465; B65B 43/16; B65B 43/30; B65B 43/32; B65B 43/62; B65B 43/54; B65B 43/56; B65B 59/005; B25J 15/0052

USPC ..... 53/570, 138.7, 571

See application file for complete search history.

(56) References Cited

FOREIGN PATENT DOCUMENTS

| | | | |
|---|---|---|---|
| JP | 59-69117 U | | 5/1984 |
| JP | 03226434 A | * | 10/1991 |
| JP | 6-156440 A | | 6/1994 |
| JP | 6-102451 B2 | | 12/1994 |
| JP | 7-2490 B2 | | 1/1995 |
| JP | 9-95318 A | | 4/1997 |
| JP | 3681563 B2 | | 8/2005 |

(Continued)

OTHER PUBLICATIONS

Office Action dated Dec. 24, 2019 for corresponding JP Application No. 2016-210417.

*Primary Examiner* — Chelsea E Stinson
*Assistant Examiner* — Mary C Hibbert-Copeland
(74) *Attorney, Agent, or Firm* — Norton Rose Fulbright US LLP

(57) ABSTRACT

A gripper device used in a bag filling and packaging machine and moved, while holding a bag, along a predetermined path to change the orientation of the bag, the gripper device including: a movable frame that is moved along the predetermined path in a horizontal plane, a pivot frame that is pivotably supported by the movable frame and has a horizontal pivot axis, a pair of gripper arms that are pivotably supported by the pivot frame and pivoted, in conjunction with each other, symmetrically in a plane parallel to the pivot axis of the pivot frame, a bag orientation changing mechanism that is installed on the movable frame and pivots the pivot frame at an angle of 90°, and a gripper arm pivot mechanism that is installed on the movable frame and pivots the pair of gripper arms.

11 Claims, 8 Drawing Sheets

(56) References Cited

FOREIGN PATENT DOCUMENTS

| | | | |
|---|---|---|---|
| JP | 3753930 | B2 | 3/2006 |
| JP | 4190692 | B2 | 12/2008 |

* cited by examiner

GRIPPER DEVICE FOR A BAG FILLING AND PACKAGING MACHINE

BACKGROUND OF THE INVENTION

1. Field of the Invention

The present invention relates to a gripper device which are provided in a plurality of numbers in a bag filling and packaging machine and moved, while holding the side edges of a bag, along a predetermined path and more particularly to a gripper device which, in the course of moving, changes a bag from a vertical orientation to a horizontal orientation or from a horizontal orientation to a vertical orientation.

2. Description of the Related Art

Patent Documents 1 to 3 discloses such gripper devices as described above,

The gripper devices disclosed in Japanese Patent Application Publication (Kokoku) Nos. H7-2490 (called "Patent Document 1") and H6-102451 (called "Patent Document 2") includes (the numbers and letters in parentheses below are those given in Patent Document 1) a movable plate (3) fixed to a timing belt (2), a shaft member (5) rotatably installed on the moving plate (3), holding pieces (7) fixed to the shaft member, and a pair of gripper arms (gripping pieces $G_1$ and $G_2$) pivotally mounted on the holding piece.

These gripper devices are provided at equidistant spacing in between on the timing belt (2), which is wound around a pair of pulleys, and are intermittently moved (intermittently rotated) along a horizontal, racetrack shape path. The lengthwise direction of the shaft member (5) is set parallel to the path for the gripper devices, and the pair of gripper arms are provided so as to be pivotable over an angular range of 90° about the shaft member as the shaft member is rotated. Also, each one the pair of gripper arms (or two gripper arms) are pivoted symmetrically over a predetermined range to open and close in a plane parallel to the lengthwise direction of the shaft member (in the present specification, narrowing or widening the spacing between the (two or pair of) gripper arms to open or close (to pull taut) the bag mouth is referred to as "close" or "open" or as "open and close" or the like).

In the course of the intermittent movement of the gripper devices along the straight portion of the path, empty bags are supplied to the gripper devices and held thereby and then the bags held by the gripper devices are subjected to various packaging steps, including opening of the bag mouth, filling of contents into the bag, sealing of the bag mouth, etc. In this process, a bag is supplied in a horizontal orientation to the gripper device, and in the bag mouth opening step, the pair of gripper arms pivots 90° to change the bag into a vertical orientation.

The gripper device disclosed in Japanese Patent No. 3,753,930 (called "Patent Document 3") includes (the numbers and letters in parentheses below are those given in Patent Document 3) a guide rod (31) fixed to an intermittently rotatable table (movable board (10)), a pair of gripper arms (arms 29, 29) fixed to a pair of sleeves (32, 32), respectively, which are slidably fitted to the guide rod (31), and a clamp (11) provided at the distal end of each one of the gripper arms so as to be pivoted about a main pin (43). These gripper devices are provided at equidistant spacing around the intermittently rotatable table and thus are intermittently moved (intermittently rotated) along a circular path. The lengthwise direction of the main pins is set to be parallel to the tangential direction of the path of the gripper devices, and thus the clamps are pivoted over an angular range of 90° about the main pins. Also, the pair of gripper arms are opened and closed by being moved symmetrically along the lengthwise direction of the guide rod.

In the course of the intermittent movement of the gripper devices along the path, empty bags are supplied to the gripper devices and held thereby, and then the bags held by the gripper devices are subjected to various packaging processing, including opening of the bag mouth, filling of contents into the bag, sealing of the bag mouth, etc. In this process, the bags are supplied in a vertical orientation to the gripper devices and are changed to a horizontal orientation before the bag mouth opening step.

In the gripper devices disclosed in Patent Documents 1 and 2, when bags of a different width are processed, it is necessary (the numbers and letters in parentheses below are those given in Patent Document 1) to loosen the bolts that fix the holding pieces (7) to the shaft member (5) for each gripper arm, adjust (so as to match the width of the bag to be processed) the spacing between the holding pieces (7) or, in other words, adjust the reference spacing between the gripper arms (the spacing of a pair of gripper arms that have been opened is referred to as the "reference spacing" in this specification), and then tighten back the bolts to fix the holding pieces (7) to the shaft member (5) again. It is also necessary to perform this adjustment work for all of the sets of gripper arms installed in the bag filling and packaging machine, which makes the work more complicated.

Also, in the gripper devices disclosed in Patent Documents 1 and 2, as can be seen from the description in Patent Document 2 (particularly from the part related to FIG. 7), when a pair of gripper arms is closed in the step of opening of the bag mouth, regardless of the size of the reference spacing, the distance that the gripper arms are pivoted is always constant. Therefore, such a problem occurs that when the bag width or the type of contents is changed, the bag mouth cannot be opened into the optimal shape for the bag width or for the kind of contents to be filled (for example, it may occur that the bag mouth is not opened in a large circular shape or in an elongated elliptical shape).

In the gripper device of Patent Document 3 (the numbers and letters in parentheses below are those given in Patent Document 3), the gripper arms (the arms 29, 29) themselves do not pivot, and only the clamps (11) provided at the distal ends of the gripper arms are pivoted about the main pins (43) over an angular range of 90°. The clamps have to be formed by relatively small parts, which are low in rigidity (strength) and have poor durability, and are prone to looseness brought about by wear of the rotating parts (the main pins (43)) and the like, making this configuration unsuitable to packaging heavy contents.

In addition, although Patent Document 3 discloses the opening and closing of pair of gripper arms, it does not disclose anything about adjustment of the reference spacing between a pair of (or two) gripper arms to accommodate bags of different widths.

BRIEF SUMMARY OF THE INVENTION

The present invention relates to an improvement in a gripper device used in a bag filling and packaging machine with which a bag can be changed, in the course of being moved, from a vertical orientation to a horizontal orientation or from a horizontal orientation to a vertical orientation, and it is an object of the present invention to provide a gripper device in which, when there is a change in the width of the bags to be processed, the reference spacing between a pair of (or two) gripper arms can be easily adjusted to be wider or narrower, and when a pair of gripper arms is opened or closed in the bag mouth opening step, etc., the movement distance of the gripper arms is adjusted easily, and further no such problems as insufficient rigidity, poor durability, etc. will occur in terms of the structure related to changing of orientation of the bags.

A gripper device according to the present invention is provided in a bag filling and packaging machine in a plurality of numbers and moved along a predetermined path, and it changes in the course of moving along the predetermined path the attitude of a bag held by the gripper device from a vertical orientation to a horizontal orientation or from a horizontal orientation to a vertical orientation, and this gripper device comprises:

- a movable frame which is moved along the predetermined path in a horizontal plane,
- a pivot frame pivotably supported by the movable frame and having a pivot axis which is horizontal,
- a pair of gripper arms provided at distal ends thereof with gripping members that are opened and closed and when closed hold side edges of a bag, said pair of gripper arms being pivotably supported by the pivot frame and opened and closed in conjunction with each other by being pivoted symmetrically in a plane which is parallel to the pivot axis of the pivot frame,
- a bag orientation changing mechanism installed in the movable frame and linked to the pivot frame so as to pivot the pivot frame for an angle of 90°, and
- a gripper arm pivot mechanism installed in the movable frame and linked to one of the gripper arms so as to pivot the pair of gripper arms to adjust a reference spacing between the pair of gripper arms and open and close the pair of gripper arms.

In a preferred embodiment of the present invention, the above-described bag orientation changing mechanism is comprised of a first cam lever that is pivotably supported by the movable frame and has a pivot axis which is parallel to the pivot axis of the pivot frame, a first cam roller that is rotatably installed at a free end of the first cam lever, and a first linking mechanism that links the first cam lever to the pivot frame. The first cam roller is in contact with the cam face of an orientation changing cam installed on the pedestal of a bag filling and packaging machine, so that the first cam roller is displaceable as the movable frame is moved along the predetermined path. In this structure, the first linking mechanism has, for example, a first pivot arm, which pivots as the first cam roller is displaced, and a first linking rod, which is linked at one end thereof to the first pivot arm and at another end thereof to the pivot frame, so that the first pivot arm and the first linking rod form a toggle mechanism.

In another preferred embodiment of the present invent ion, the above-described gripper arm pivot mechanism is comprised of a second cam lever that is pivotably supported by the movable frame and has a pivot axis that is horizontal and in a plane which is perpendicular to the pivot axis of the pivot frame, a second cam roller that is rotatably installed at a free end of the second cam lever, and a second linking mechanism that links the second cam lever to one of the gripper arms. The second cam roller is in contact with the cam face of a gripper pivot cam which is shared by (or is commonly used for) all the gripper devices and is installed on the pedestal of a bag filling and packaging machine, so that the second cam roller is displaceable as the movable frame is moved along the predetermined path.

As seen from the above, in the gripper device according to the present invention, a pair of gripper arms is installed on a pivot frame that is pivotably supported in a movable frame, and the pivot frame is pivoted for an angle of 90° so that the pair of gripper arms are pivoted up and down as a whole for an angle of 90°. Accordingly, problems such as poor durability or a lack of rigidity in the structure of the portion of a gripper device related to the changes in the orientation of bags can be avoided, and it is possible that the gripper device can be used for packaging relatively heavy contents.

In addition, in the gripper device according to the present invention, a gripper arm pivot mechanism that pivots a pair of gripper arms in symmetry to each other is provided. Accordingly, when the width of bags is changed, the reference spacing between the pair of gripper arms can be simultaneously and easily adjusted for all the gripper devices. In addition, the moving distance of the gripper arms, when opening and closing the pair of gripper arms in a bag mouth opening step, etc., can be easily and simultaneously adjusted for all the gripper devices.

DETAILED DESCRIPTION OF THE INVENTION

Figure 1:
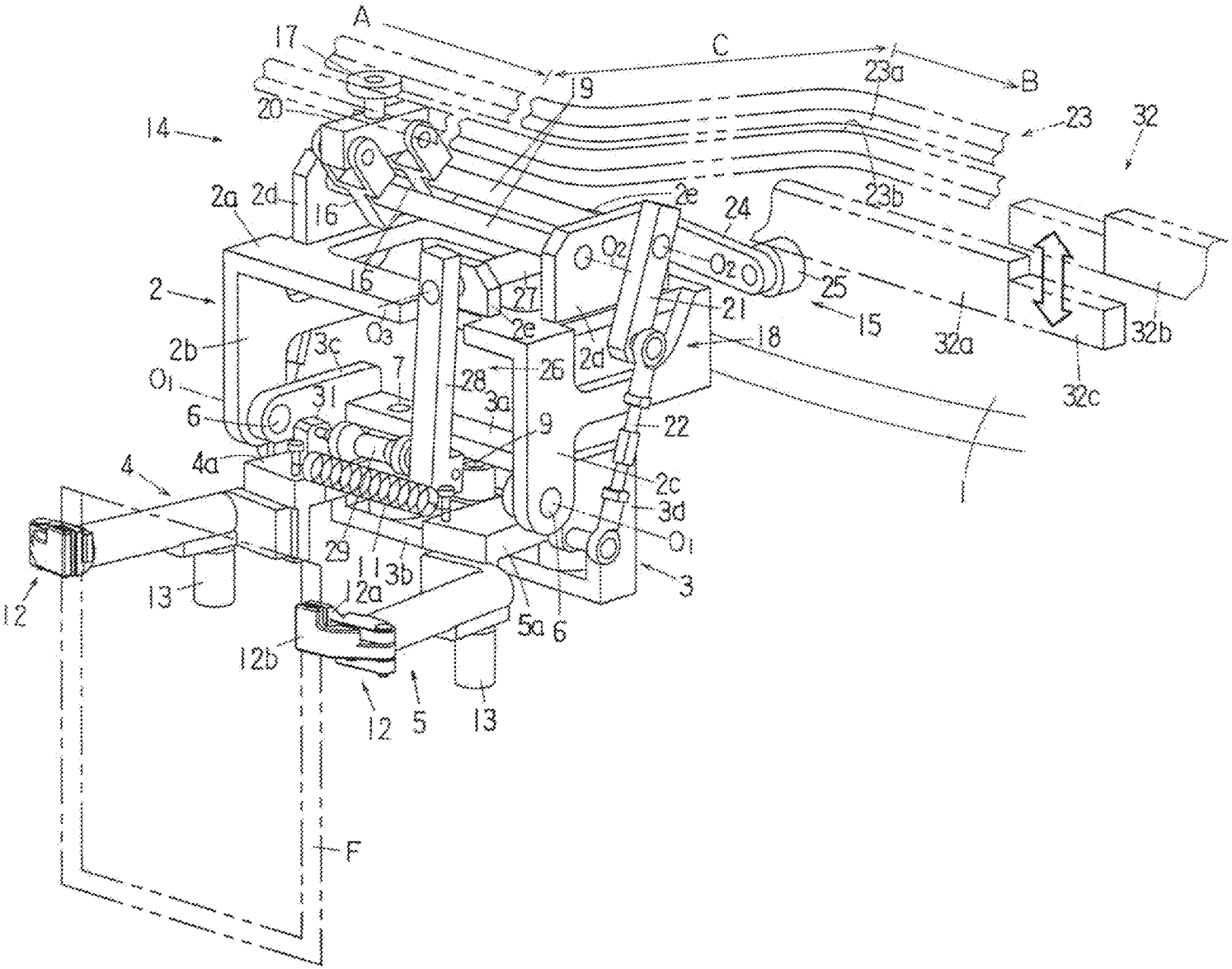
FIG. 1 is a perspective view showing the gripper arms in a horizontal state in a gripper device according to the present invention.

In a bag filling and packaging machine, particularly in a rotary bag filling and packaging machine, a plurality of gripper devices are provided at equidistant spacing on the circumference of a circular table that rotates continuously or intermittently. As the table rotates intermittently, the gripper devices are moved intermittently along a predetermined circular path, bags are supplied to the gripper devices one by one in the course of this intermittent movement and held by the gripper devices, and then the bags held by the gripper devices are subjected to various kinds of packaging processing, including opening of the bag mouth, filling of the bag with its contents, sealing of the bag mouth, and so forth.

A case in which the gripper device according to the present invention is provided in an intermittently rotating rotary bag filling and packaging machine will be described below concretely with reference to FIGS. 1 to 6. In this rotary bag filling and packaging machine, the following steps are sequentially carried out while each gripper device makes one revolution (during the intermittent movement).

(1) Bag Supply Step

When the gripper device is stopped at a bag supply step position, a bag (empty bag) in a vertical orientation is supplied to the gripper device, and the side edges of the bag are clamped (held) by gripping members provided at distal ends of a pair of gripper arms of the gripper device, so that the bag is (as seen from FIG. 1) held in a vertical orientation (taking a hanging down state).

(2) Bag Mouth Opening Step

When the gripper device that holds the bag is next stopped at a bag mouth opening step position, a pair of suction cups approach the two sides of the bag, come into contact and stick to the sides, and then move away from each other by a predetermined distance to thus open the mouth of the bag. At the same time, the pair of gripper arms are pivoted inward in a horizontal plane and moved to come closer (and the gap between gripper arms are narrowed), thus opening the mouth of the bag smoothly.

(3) Bag Orientation Changing Step (Vertical to Horizontal)

The bag orientation changing step is performed while the gripper device are being moved between the bag mouth opening step position and the filling step position (described below). In this bag orientation changing step, the pair of gripper arms are pivoted 90° downward to change from the horizontal orientation to a downward (vertical) orientation, thus changing the bag from its vertical orientation to a horizontal orientation (as seen from FIG. 2).

(4) Contents Filling Step

Then, when the gripper device is next stopped at a filling step position, the bag is filled with its contents while being held in the horizontal orientation by the gripper device. At this point, the lower face of the bag is supported by a bottom (supporting) plate (see Patent Document 3).

(5) Bag Orientation Changing Step (Horizontal to Vertical)

The bag orientation changing step is next performed while the gripper device is being moved between the filling step position and a sealing step position (described below). In this step, the pair of gripper arms are pivoted 90° upward to change from the downward (vertical) orientation to a horizontal orientation, and the bag filled with the content is changed from the horizontal orientation to a vertical orientation.

(6) Bag Mouth Sealing Step

When the gripper device is stopped next at the sealing step position, the gripper arms are pivoted outward in a horizontal plane and opened up (or moved away from each other) to widen the gap between them, so that the mouth of the filled bag held by the gripping members of the gripper arms is pulled taut to be closed. In this state, the bag mouth is clamped by a pair of hot plates and sealed.

(7) Finished Bag Release Step

When the gripper device is stopped at a bag release step position, the gripping members of the gripper device are opened up, and the finished bag with the contents inside and its mouth sealed falls and is carried out of the bag filling and packaging machine.

The gripper device according to the present invention will be described below in detail. As seen from FIG. 1, the gripper device is comprised of a movable frame 2 that is disposed on an intermittently rotating round table 1, a pivot frame 3 that is pivotably supported by the movable frame 2, and a pair of gripper arms 4 and 5 that are pivotably provided on the pivot frame 3.

The movable frame 2 includes a horizontal wall 2*a* and a pair of vertical walls 2*b* and 2*c*. The pivot frame 3 is disposed between the vertical walls 2*b* and 2*c* under the horizontal wall 2*a* of the movable frame 2. Support shafts 6 fixed to the pivot frame 3 are rotatably supported by the lower ends on the outside diameter side (the radial direction as viewed from the center of the table 1) of the respective vertical walls 2*b* and 2*c* of movable frame 2, so that the pivot frame 3 is pivotable about the pivot axis $O_1$ (which is an axis passing through the centers of the support shafts 6, 6). The pivot axis $O_1$ is horizontal and is parallel to the tangential direction of the path (circular path) on which the gripper devices are moved.

The pivot frame 3 is comprised of support walls 3*a* and 3*b* disposed one above the other in FIG. 1 and a pair of vertical walls 3*c* and 3*d* that connect the support walls 3*a* and 3*b* together. Support shafts 7 and 8 are fixed to the base portions 4*a* and 5*a* of the gripper arms 4 and 5, and these shafts 7 and 8 are rotatably supported by the support walls 3*a* and 3*b* of the pivot frame 3. A pin 9 is fixed to the base portion 4*a* of the gripper arm 4, and a slot (not shown) is formed in the base portion 5*a* of the gripper arm 5, so that the pin 9 is provided to pass through this slot (see FIG. 3 of Japanese Patent Application Laid-Open (Kokai) No. H9-95318). As a result, the gripper arms 4 and 5 are pivotable symmetrically with each other in a plane that is parallel to the pivot axis $O_1$ (and in a horizontal plane in FIG. 1).

A tension spring 11 (which is a part of a gripper arm pivot mechanism 15 (described below)) is installed between the base portions 4*a* and 5*b* of the gripper arms 4 and 5 to urge the gripper arms 4 and 5 inwardly (or in the closing direction or toward each other) at all times.

Gripping members 12, 12 that are capable of opening and closing to clamp (hold) side edges of a bag when closed are provided at the distal ends of the gripper arms 4 and 5. Each gripping member 12 is composed of a stationary clamping piece 12*a* and a movable clamping piece 12*b*. The movable clamping piece 12*b* is at all times urged in the closing direction (or toward the stationary clamping piece 12*a*) by biasing force of the compression spring mechanisms installed inside the gripper arms 4 and 5 (not shown, see FIG. 2 of Japanese Patent Application Laid-Open (Kokai) No. 6-156440). Rollers 13 are linked to the rear ends (the pivot frame 3 side) of the compression spring mechanisms, and pressing members (not shown) that advances and retreats by a drive source is provided near the bag supply step position and the release step position of the bag filling and packaging machine. As a result, when the pressing members are advanced (by the drive source) to push the rollers 13 forward (or toward the gripping members 12 side), the movable clamping piece 12*b* are opened against the biasing force of the compression spring mechanisms.

The gripper device according to the present invention further includes a bag orientation changing mechanism 14 and a gripper arm pivot mechanism 15. The bag orientation changing mechanism 14 pivots the pivot frame 3 by 90° from a horizontal state (the state in FIG. 1) to a vertical state (the state in FIG. 2) or from a vertical state (the state in FIG. 2) to a horizontal state (the state in FIG. 1). The gripper arm pivot mechanism 15 causes the gripper arms 4 and 5 to pivot so as to be opened and closed and also adjusts the reference spacing between the gripper arms.

The bag orientation changing mechanism 14 of the gripper device is composed of a pair of (or two) first cam levers 16, a first cam roller 17 that is rotatably provided on the first cam levers 16 via a support block 20, and a first linking mechanism 18 that links the pivot frame 3 and one of the first cam levers 16.

The first cam levers 16 are both fixed to the support shafts 19, respectively, and the support shafts 19 are rotatably supported by a pair of support portions 2*d* installed on the horizontal wall 2*a* of the movable frame 2. The support shafts 19 are both parallel to the pivot axis $O_1$ and horizontal, and the first cam levers 16 are pivoted about a pivot axis $O_2$ (which passes through the center of each of the support shafts 19) that is parallel to the pivot axis $O_1$. The first cam roller 17 is provided on the support block 20 that is linked to free ends of the first cam levers 16. Since the support shafts 19, the first cam levers 16, and the support block 20 form a sort of parallel link mechanism, even if the first cam levers 16 are pivoted, the support block 20 always stays in its horizontal state, and the axial center of the first cam roller 17 always in the vertical direction.

Figure 2:
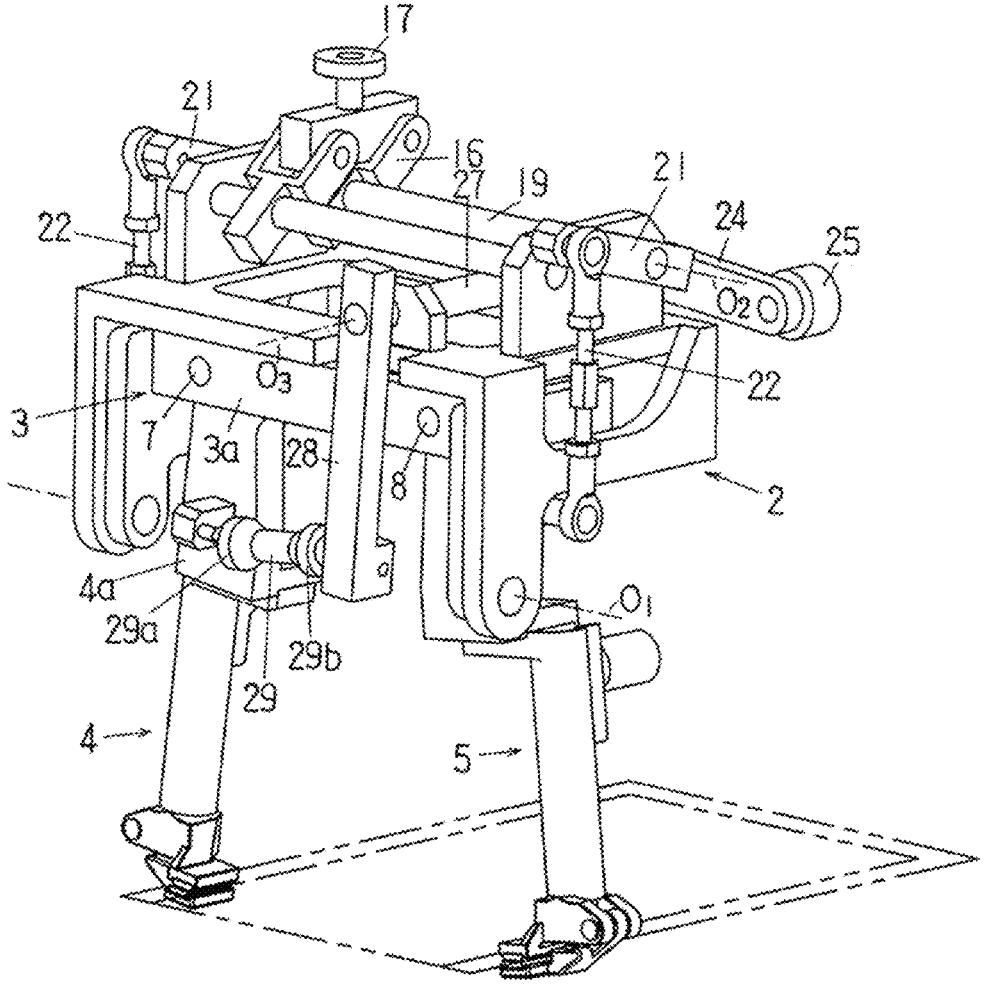
FIG. 2 is a perspective view (a portion of which is omitted) of the gripper arms in a downward orientation in a gripper device according to the present invention.

The first linking mechanism 18 is composed of a pair of first pivot arms 21 and a pair of first linking rods 22 (see FIG. 2). Each first pivot arm 21 is fixed at its one end to one of the support shafts 19. Each first linking rod 22 is linked at its one end to the other end of each first pivot arm 21 and at its another end to the vertical wall 3*d* of the pivot frame 3. The first pivot arms 21 is pivotable about the same pivot axis $O_2$ of one of the first cam levers 16.

On the pedestal of the rotary bag filling and packaging machine, an orientation changing cam 23 that is shared by the installed gripper devices is provided in a horizontal plane. The orientation changing cam 23 is in a ring shape and is provided along the table 1. This orientation changing cam 23 is a positive cam, and it has an inner cam face 23*a* and an outer cam face 23*b* which are disposed at a constant spacing in a horizontal plane. The first cam roller 17 of the bag orientation changing mechanism 14 is provided between the cam faces 23*a* and 23*b* and is in contact with the cam faces 23*a* and 23*b*. When the movable frame 2 is intermittently moved by the intermittent rotation of the table 1, the first cam roller 17 is moved (rolls) along the orientation changing cam 23 while rotating between the cam faces 23*a* and 23*b*. The trajectory on which the axial center of the first cam roller 17 is moved is an arc of a radius R (not shown) in the area from the sealing step position to the bag mouth opening step position (referred to as "area A"), and it is also an arc of a radius r (not shown) (R>r) at the filling step position and the nearby regions (referred to as "area B"); and the areas between the area A and the area B and between the area B and the area A are defined as transition regions (referred to respectively "area C" and "area D"). The first cam roller 17 is not displaced when moving in the areas A and B but is displaced along the cam faces 23*a* and 23*b* of the orientation changing cam 23 when moving in the areas C and D.

When the first cam roller 17 is moved in the area A, as seen from FIG. 1, the pivot frame 3 is in a horizontal state and the gripper arms 4 and 5 are also in a horizontal orientation, while the gripping members 12 (the stationary clamping pieces 12*a* and the movable clamping pieces 12*b*) are vertical, and a bag held by the gripping members 12 is in a vertical orientation.

As shown in FIG. 2, when the first cam roller 17 is moved in the area B, the pivot frame 3 is in a vertical state (the gripper arms 4 and 5 are in a downward orientation), the gripping members 12 (the stationary clamping pieces 12*a* and the movable clamping pieces 12*b*) are in horizontal, and the bag held by the gripping members is in a horizontal orientation. FIG. 2 is drawn to focus on just the functions of the bag orientation changing mechanism 14 and the orientation changing cam 23, and the gripper arms 4 and 5 are not in a closed position (and the spacing between the gripper arms 4 and 5 is not narrowed from the state in FIG. 1).

When the first cam roller 17 is moved in the area C, which is between the area A and the area B, the first cam roller 17 is displaced to the inside diameter side of the above-described predetermined path for the gripper devices. As a result, the first cam levers 16 are pivoted, and the pivot frame 3 transitions from the horizontal state (see FIG. 1) to a vertical state (see FIG. 2) via the first linking mechanism 18 (which is comprised of the first pivot arms 21 and the first linking rods 22). Further, when the first cam roller 17 is moved in the area D (not shown, which is between the area B and the area A), the first cam roller 17 is displaced back into the opposite direction (the outside diameter side of the path of the gripper devices), so that the first cam levers 16 are pivoted in the opposite direction, the pivot frame 3 transitions from the vertical state (see FIG. 2) to a horizontal state (see FIG. 1) via the first linking mechanism 18 (comprised of the first pivot arms 21 and the first linking rods 22).

The gripper arm pivot mechanism 15 of the gripper device is composed of a second cam lever 24, a second cam roller 25 rotatably installed at a free end of the second cam lever 24, a second linking mechanism 26 that links the second cam lever 24 and one of the gripper arms 4 (at the base portion 4*a*), and the tension spring 11.

The second cam lever 24 is fixed to one end of a support shaft 27 which is rotatably supported by a pair of support portions 2*e* installed on the horizontal wall 2*a* of the movable frame 2. The support shaft 27 is horizontal and in top view is perpendicular to the pivot axis $O_1$, and the second cam lever 24 is pivotable about a pivot axis $O_3$ (which passes through the center of the support shaft 27) which is in a horizontal plane and is perpendicular to the pivot axis $O_1$. The second cam roller 25 is provided at a free end of the second cam lever 24, and its axial center is horizontal.

The second linking mechanism 26 of the gripper arm pivot mechanism 15 is comprised of a second pivot arm 28 and a second linking rod 29, and the second pivot arm 28 is fixed at its one end (the upper end) to the other end of the support shaft 27. The second pivot arm 28 is similar to the second cam lever 24 in that it is pivotable about the pivot axis $O_3$. The axial center of the second linking rod 29 is disposed in a position that substantially overlaps the pivot axis $O_1$ of the pivot frame 3, and the second linking rod 29 is connected at its one end to the other end (the lower end) of the second pivot arm 28 and at its other end to the base portion 4*a* of the gripper arm 4 via a support portion 31. The second linking rod 29 includes spherical sliding bearings 29*a* and 29*b* that are self-alignment capability at both ends (thus inclination of its axis permitted). The axial center of the second linking rod 29 is, as described above, disposed in a position substantially overlapping the pivot axis $O_1$ of the pivot frame 3; accordingly, even if the pivot frame 3 is pivoted 90°, the second linking rod 29 does not twist very much and remains in substantially the same position (see FIGS. 1 and 2).

On the pedestal of the rotary bag filling and packaging machine, a gripper pivot cam 32 that is shared by all the gripper devices and is in substantially a ring shape when viewed from above is provided. The second cam roller 25 of gripper arm pivot mechanism 15 is provided so as to be in contact with the cam face (the lower face) of the gripper pivot cam 32. The gripper pivot cam 32 is composed of a lower portion 32*a*, a higher portion 32*b*, and a first movable portion 32*c* and a second movable portion (not shown) disposed between the lower portion 32*a* and the higher portion 32*b*. The cam surfaces of both lower portion 32*a* and higher portion 32*b* are provided horizontally. The first movable portion 32*c* and the second movable portion are provided so as to be raised and lowered by a drive source (not shown). When the movable frame 2 is stopped at the bag mouth opening step position, the second cam roller 25 is stopped at the position of the first movable portion 32*c*; and when the movable frame 2 is stopped at the sealing step position, the second cam roller 25 is stopped at the position of the second movable portion.

As the table 1 intermittently rotates, the movable frame 2 is intermittently moved; and the second cam roller 25 intermittently is moved (rolls) while rotating along the gripper pivot cam 32. The second cam roller 25 is displaced when it is moved from the lower portion 32*a* to the higher portion 32*b* and reversely displaced when moved from the higher portion 32*b* to the lower portion 32*a*.

Figure 3:
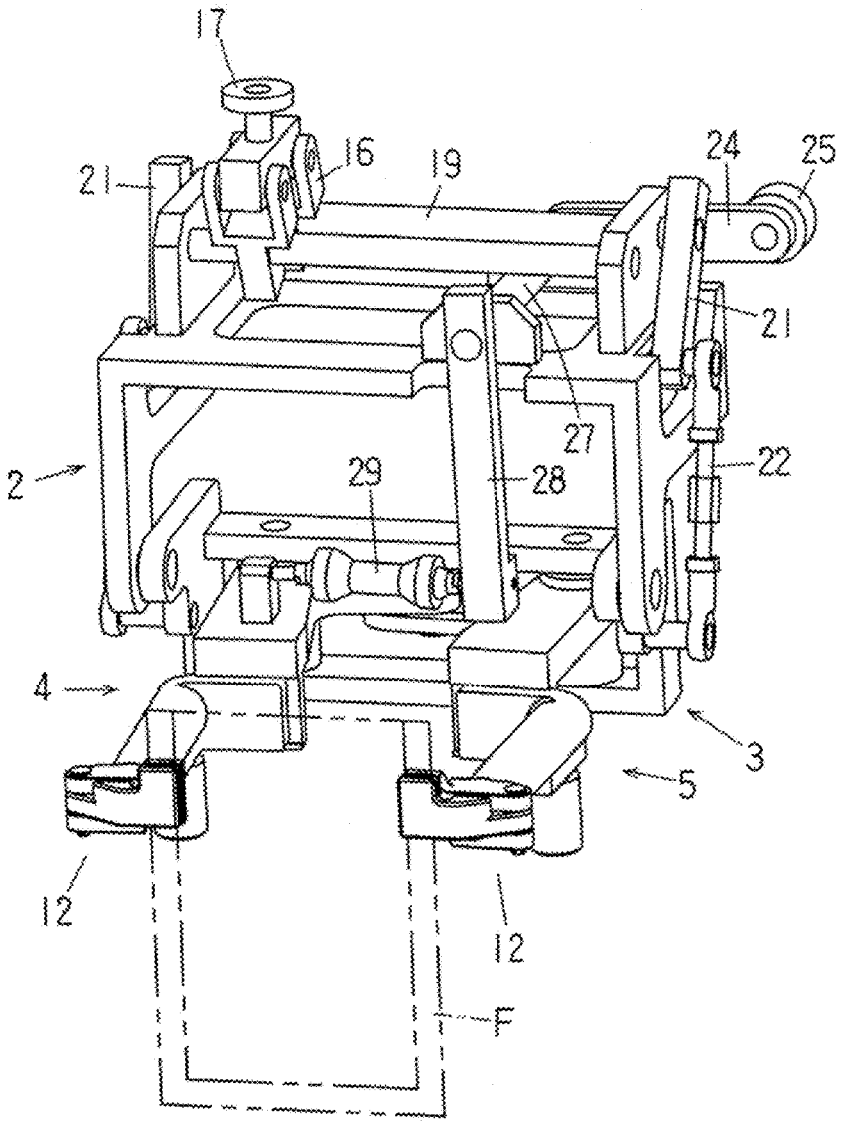
FIG. 3 is a perspective view (a portion of which is omitted) of the pair of gripper arms in a horizontal state with a reference spacing between the gripper arms is narrowed in a gripper device according to the present invention.

While the second cam roller 25 is moving (rolling) along the lower portion 32*a* of the gripper pivot cam 32, the pair of gripper arms 4 and 5 are in their open state (a state in which the gap between them is widened); and thus when the gripping members 12 of the pair of gripper arms 4 and 5 are holding both side edges of the bag F, the mouth of that bag is in a state of being pulled taut (see FIG. 1 or 3). When the movable frame 2 then reaches the vicinity of the bag mouth opening step position, the second cam roller 25 transitions from the lower portion 32*a* to the first movable portion 32*c*. At this point, since the cam face of the first movable portion 32*c* is located at the same height as the cam face of the lower portion 32*a*, this transition of the second cam roller 25 is made smoothly.

Figure 5:
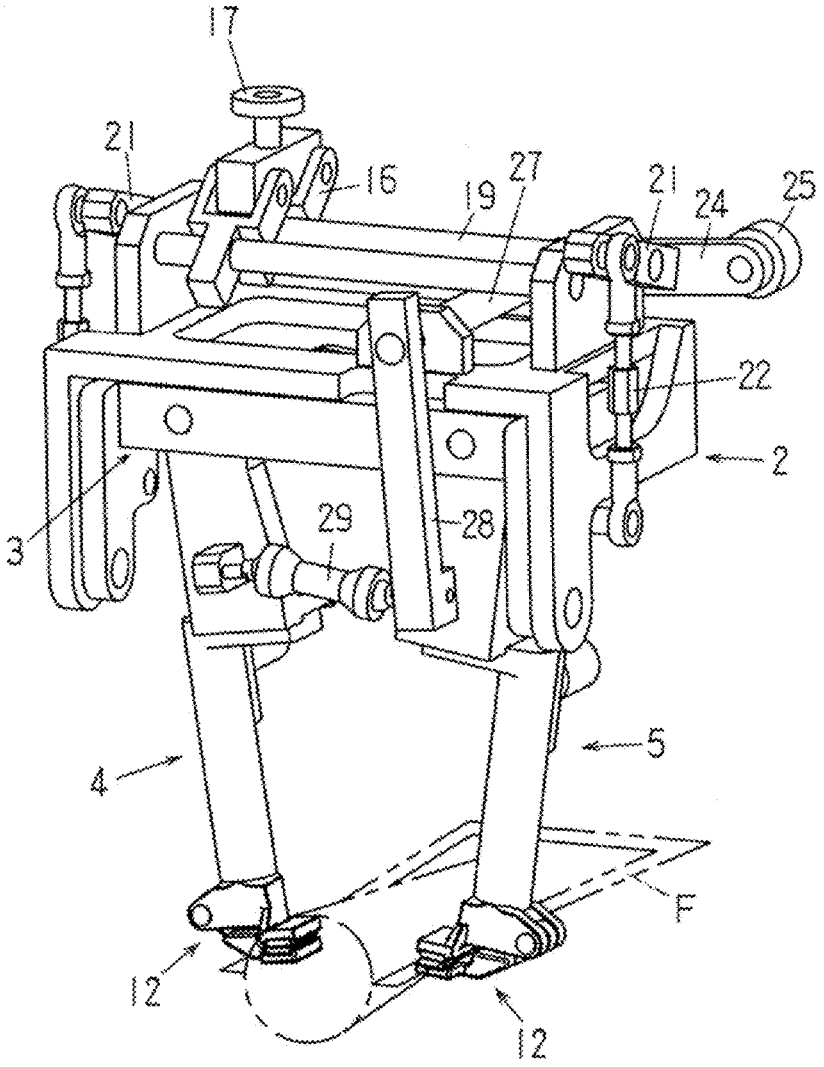
FIG. 5 is a perspective view (a portion of which is omitted) of the pair of the gripper arms in a downward orientation with a reference spacing between the gripper arms is narrowed, the gripper arms being closed so that the mouth of a bag is opened in a gripper device according to the present invention.

When the movable frame 2 is stopped at the bag mouth opening step position, a drive source for raising and lowering the first movable portion 32*c* of the gripper pivot cam 32 is actuated; as a result, the first movable portion 32*c* is raised, and thus the cam face of the first movable portion 32*c* reaches the same height as the cam face of the higher portion 32*b*. When the first movable portion 32*c* is thus raised, the biasing force of the tension spring 11 causes the second cam roller 25 to be displaced (raised) so that the second cam lever 24 is pivoted upward, and the pair of gripper arms 4 and 5 (as shown in FIG. 5) go into their closed state (a state in which the gap between them is narrowed) via the second linking mechanism 26 (or by the second pivot arm 28 that pivots counter-clockwise in FIG. 1).

As the movable frame 2 is further moved, the second cam roller 25 transitions from the first movable portion 32*c* to the higher portion 32*b* of the gripper pivot cam 32. At this point, since the cam face of the first movable portion 32*c* is located at the same height as the cam face of the higher portion 32*b*, this transition of the second cam roller 25 is made smoothly. After the second cam roller 25 has transitioned to the higher portion 32*b* from the first movable portion 32*c*, the drive source for raising and lowering the first movable portion 32*c* is actuated, and the first movable portion 32*c* is thus lowered to its original position. While the second cam roller 25 is moving (rolling) along the higher portion 32*b*, the pair of gripper arms 4 and 5 are maintained in their closed state. When movable frame 2 reaches the vicinity of the sealing step position, the second cam roller 25 transitions from the higher portion 32*b* to the second movable portion (not shown). At this point, since the cam face of the second movable portion is located at the same height as the cam face of the higher portion 32*b*, this transition of the second cam roller 25 is made smoothly.

When the movable frame 2 is stopped in the sealing step position, a drive source for raising and lowering the second movable portion is actuated, the second movable portion is thus lowered, and the cam face of the second movable portion reaches the same height as the cam face of the lower portion 32*a*. When the second movable portion is thus lowered, the second cam roller 25 is displaced (pushed down) against the biasing force of the tension spring 11, the second cam lever 24 is pivoted downward, and the pair of gripper arms 4 and 5 go into their open state (a state in which the gap between them is widened) via the second linking mechanism 26 (or by the second pivot arm 28 that pivots clockwise in FIG. 1).

As the movable frame 2 is further moved, the second cam roller 25 transitions from the second movable portion to the lower portion 32*a*. At this point, since the cam face of the second movable portion is located at the same height as the cam face of the lower portion 32*a*, this transition of the second cam roller 25 is made smoothly. After the second cam roller 25 has transitioned from the second movable portion to the lower portion 32*a*, the drive source for raising and lowering the second movable portion is actuated, and the second movable portion is raised to its original position.

If the gripper pivot cam 32 (that includes the lower portion 32*a*, the higher portion 32*b*, the first movable portion 32*c* and the second movable portion) is a positive motion cam just like the orientation changing cam 23, the tension spring 11 that urges the gripper arms 4 and 5 inward can be omitted. In other words, if the gripper pivot cam 32 includes an upper cam face and a lower cam face disposed one above the other with a specific gap in between, and the second cam roller 25 is disposed between these cam faces, and the second cam roller 25 rolls in contact with these cam faces, then there will be no need to provide the tension spring 11 that urges the gripper arms 4 and 5 inwardly (or toward each other).

In the above-described the gripper pivot cam 32, the installation heights at which the lower portion 32*a* and the higher portion 32*b* are provided can be changed as needed independently of one another. Also, as to the first movable portion 32*c* and the second movable portion, the raising end position and the lowering end position thereof can be changed as needed so as to comply with the changed height at which the lower portion 32*a* and the higher portion 32*b* are set.

First, if the height of the lower portion 32*a* (or the height of its cam face) is changed, this changes the reference spacing of the pair of gripper arms 4 and 5 (the spacing when the pair of gripper arms 4 and 5 are opened) for all of the plurality of the gripper devices in the rotary bag filling and packaging machine. When this height change is made, the lowering end positions of the first movable portion 32*c* and the second movable portion need to be set to match the changed height of the lower portion 32*a*. The reference spacing between the gripper arms 4 and 5 can thus be changed as needed for all of the gripper devices merely by changing the height of the lower portion 32*a*; accordingly, the gripper device of the present invention can easily accommodate the changes in the width of the bags.

On the other hand, when the height of the higher portion 32*b* of the gripper pivot cam 32 (the height of the cam face) is changed, this changes the distance that the gripper arms 4 and 5 are moved when closing (in other words, the spacing between the gripper arms 4 and 5 when closed) for all of the plurality of the gripper devices in the rotary bag filling and packaging machine. When this height change is made, the raising end position of the first movable portion 32*c* and the second movable portion need to be set to match the height of the higher portion 32*b*. The spacing between the gripper arms 4 and 5 when closed can be changed as needed for all of the gripper devices merely by changing the height of the higher portion 32*b*; accordingly, a desired opening shape of bag mouth (such as circular or a long elliptical shape) can be selected as needed when the type of bag is changed, etc.

Needless to say, the height of the lower portion 32*a* and the height of the higher portion 32*b* of the gripper pivot cam 32 can be changed simultaneously when the type of bag or the width of the bags is changed, etc. In this case, it is necessary to adjust the lowering end position and the raising end position of the first movable portion 32*c* and the second movable portion.

Figure 4:
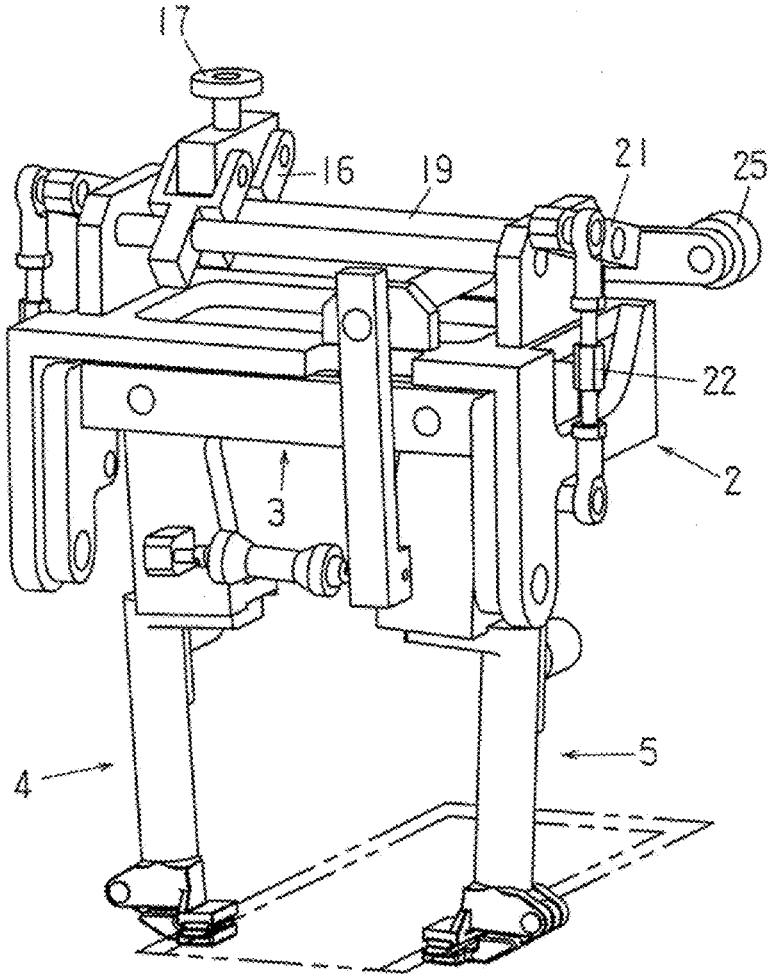
FIG. 4 is a perspective view (a portion of which is omitted) of the pair of gripper arms in a downward orientation with a reference spacing between the gripper arms is narrowed in a gripper device according to the present invention.

FIGS. 3 and 4 show an example in which the installation heights of the lower portion 32*a* and the higher portion 32*b* of the gripper pivot cam 32 are changed, and the raising end position and the lowering end position of the first movable portion 32*c* and the second movable portion are also changed. The gripper pivot cam 32 is not shown in FIGS. 3 and 4. In both FIGS. 3 and 4, just as in FIGS. 1 and 2, the gripper arms 4 and 5 are illustrated in their open state (a state in which the spacing between them is widened), and the bag held by the gripper arms is in a state of being pulled taut.

In the example of FIGS. 3 and 4, a bag of a narrower width is used than in the example of FIGS. 1 and 2, and the lower portion 32*a* and the higher portion 32*b* of the gripper pivot cam 32 are installed at a higher height. Accordingly, the position of the second cam roller 25 is higher than in the example of FIGS. 1 and 2, and the reference spacing between the gripper arms 4 and 5 (the spacing when the pair of gripper arms 4 and 5 are opened) is narrower, so that bags of a narrower width can be accommodated.

Figure 6:
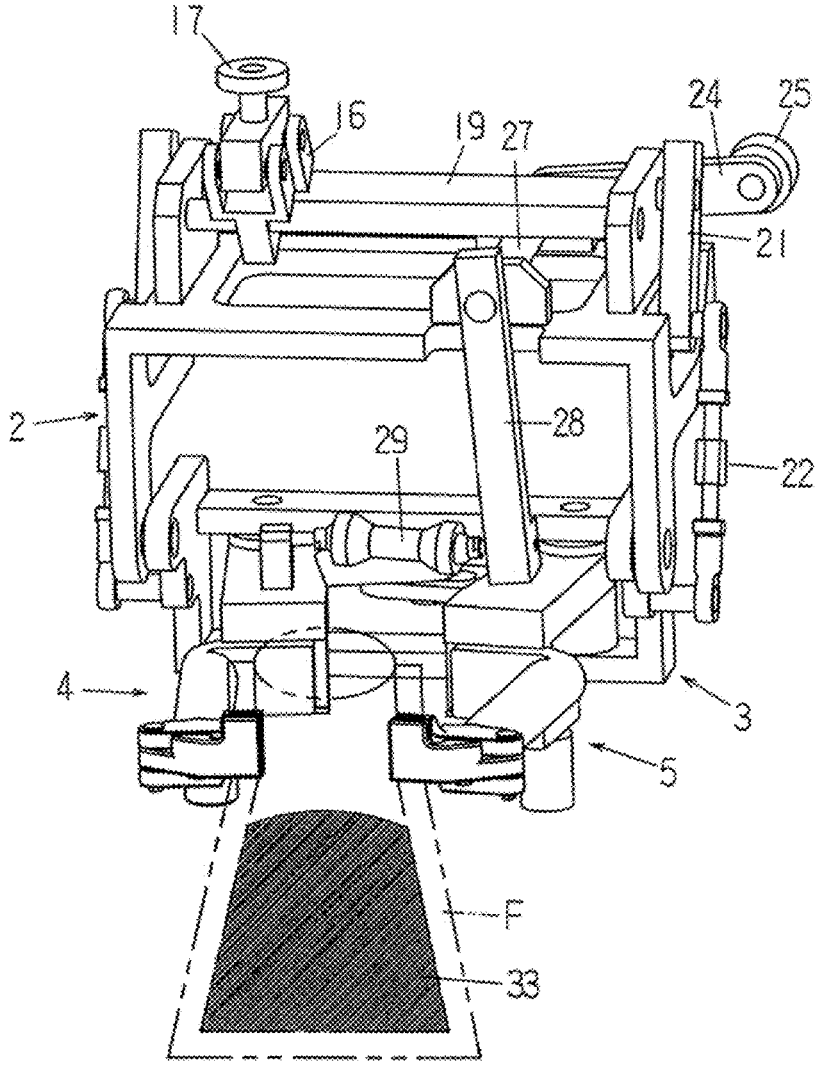
FIG. 6 is a perspective view (a portion of which is omitted) of the pair of gripper arms in a horizontal state with a reference spacing between the gripper arms is narrowed, the gripper arms being closed so that the mouth of a bag is opened in a bag mouth opening step in a gripper device according to the present invention.

The operation of the above-described rotary bag filling and packaging machine (mainly the gripper devices) will now be described below with reference to FIGS. 3, 5, and 6 (see FIG. 1 for the orientation changing cam 23 and the gripper pivot cam 32) in the order of packaging steps described above.

(1) Bag Supply Step

When the gripper device is stopped in the bag supply step position, the first cam roller 17 of bag orientation changing mechanism 14 is located in the area A of the orientation changing cam 23, and the second cam roller 25 of gripper arm pivot mechanism 15 is located at the lower portion 32*a* of the gripper pivot cam 32. Therefore, the gripper arms 4 and 5 are in the horizontal orientation and in the open state. In other words, as shown in FIG. 3, the bag F is supplied to the gripper device in a vertical orientation, and the side edges of the bag are clamped (held) by the gripping members 12 of the gripper arms 4 and 5 so that the bag F is held in a vertical orientation (a state of hanging down).

(2) Bag Mouth Opening Step

When the gripper device is next stopped in the bag mouth opening step position, since the first cam roller 17 is located in the area A of the orientation changing cam 23, the pivot frame 3 is in the horizontal state and the gripper arms 4 and 5 are in the horizontal orientation. The second cam roller 25 is located at the first movable portion 32*c* of the gripper pivot cam 32. Then, a pair of suction cups (not shown) are moved close to and contact with both sides of the bag F and stick thereto. The suction cups are then moved away from each other by a predetermined distance; and at the same time the first movable portion 32*c* of the gripper pivot cam 32 (and thus the second cam roller 25 as well) is raised, the pair of gripper arms 4 and 5 are thus pivoted inward so as to be closed (a state in which the gap between them is narrowed), and as a result the bag mouth is opened. The state in which the gripper arms 4 and 5 are closed is illustrated in FIG. 6 (the contents 33 have not been inserted yet in this bag mouth opening step).

(3) Bag Orientation Changing Step (Vertical to Horizontal)

While the gripper device leaves the bag mouth opening step position and is being moved toward the filling step position, the first cam roller 17 passes through the area C of the orientation changing cam 23. In the course of this process, the pivot frame 3 (and thus the pair of gripper arms 4 and 5 as well) is pivoted for 90° downward, so that the pivot frame 3 is changed into a vertical state and the gripper arms 4 and 5 face downward, and the bag F held by the gripping members 12 is changed to a horizontal orientation. On the other hand, the second cam roller 25 is transitioned to the position of the higher portion 32*b* of the gripper pivot cam 32, and the pair of gripper arms 4 and 5 remain closed. This state is shown in FIG. 5

(4) Contents Filling Step

When the gripper device is next stopped at the filling step position, the first cam roller 17 is located in the area B of the orientation changing cam 23, and the second cam roller 25 is located at the higher portion 32*b* of the gripper pivot cam 32, so that the pair of gripper arms 4 and 5 remain in a state of being closed and facing downward (see FIG. 5). In this state, the bag F is filled with the contents 33 (see FIG. 6).

(5) Bag Orientation Changing Step (Horizontal to Vertical)

While the gripper device leaves the filling step position and is being moved toward the sealing step position, the first cam roller 17 passes through the area D (not shown) of the orientation changing cam 23; and in the course of this movement, the pivot frame 3 (and the pair of gripper arms 4 and 5 as well) are pivoted for 90° upward so as to be changed into a horizontal state, and thus the bag F (filled) held by the gripping members 12 is changed to a vertical orientation. Meanwhile, the second cam roller 25 is located at the higher portion 32*b* of the gripper pivot cam 32, and the pair of gripper arms 4 and 5 remain closed. This state is shown in FIG. 6.

(6) Bag Mouth Sealing Step

When the gripper device is next stopped at the sealing step position, the first cam roller 17 is located in the area A of the orientation changing cam 23, and the gripper arms 4 and 5 are thus in the horizontal orientation. The second cam roller 25 is located at the second movable portion (not shown) of the gripper pivot cam 32. Then, the second movable portion (and thus the second cam roller 25) is lowered, so that the pair of gripper arms 4 and 5 are pivoted outward so as to open, the bag mouth is thus closed and pulled taut by the gripper arms 4 and 5. In this state, the bag mouth is sandwiched by a pair of hot plates and sealed, so that the bag becomes a product bag.

(7) Finished Bag Release Step

When the gripper device is stopped next at the release step position, the gripping members 12 of the gripper device are opened up, so that the product bag falls and moved out of the machine. At this point, the first cam roller 17 is in the area A of the orientation changing cam 23, the second cam roller 25 has transitioned to the lower portion 32*a* of the gripper pivot cam 32, and thus the pair of gripper arms 4 and 5 are in the horizontal state and opened.

Figure 7:
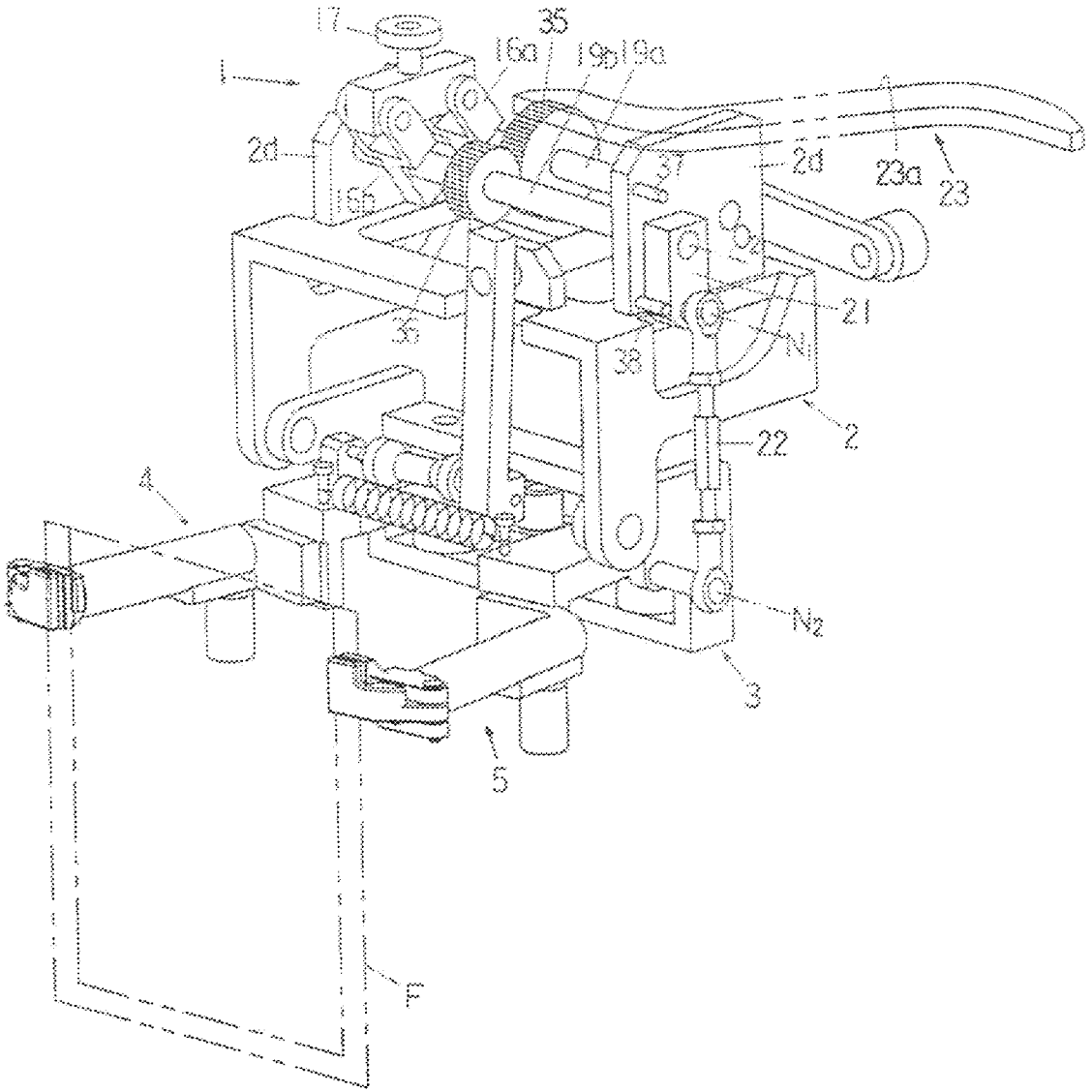
FIG. 7 is a perspective view showing the gripper arms in a horizontal state in another gripper device according to the present invention.
Figure 8:
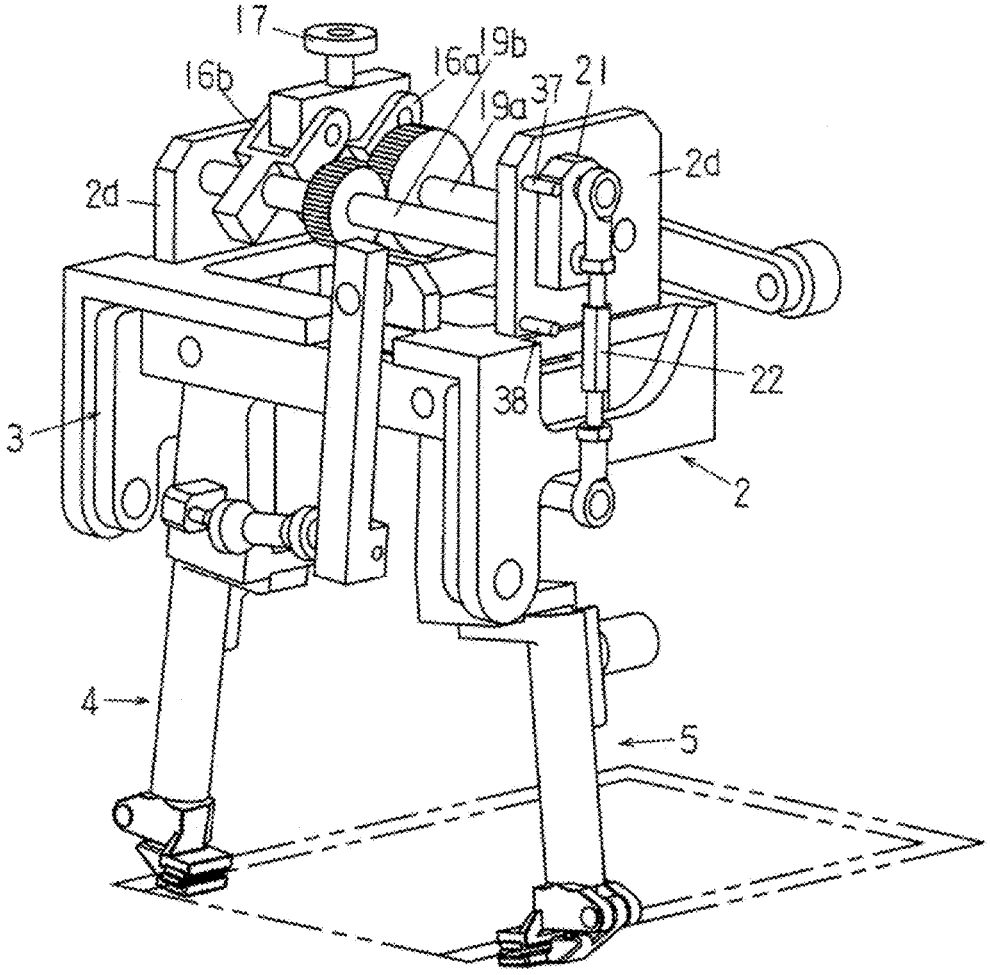
FIG. 8 is a perspective view (a portion of which is omitted) of the gripper arms in a downward orientation in another gripper device according to the present invention.

FIGS. 7 and 8 show another gripper device according to the present invention. In FIGS. 7 and 8, those components that are substantially the same as those of the gripper device of FIGS. 1 and 2 are marked with the same reference numbers and letters.

The gripper device of FIGS. 7 and 8 differs from the gripper device of FIGS. 1 and 2 in terms of a part of the bag orientation changing mechanism 14. The differences are as follows:

(1) Of the pair of first cam levers 16, the first cam lever 16*a* (one of the pair of cam levers) is fixed to the support shaft 19*a*, but the other first cam lever 16*b* (the other one) is not fixed to the support shaft 19*b* and is in a loosely fitted state thereon.

(2) A larger-diameter gear 35 is fixed to the support shaft 19*a*, and a smaller-diameter gear 36 that meshes with the larger-diameter gear 35 is fixed to the support shaft 19*b*. Accordingly, the rotational angle of the support shaft 19*b* is greater than the pivot angle of the first cam lever 16*a* (and also than the rotational angle of the support shaft 19*a*). As the first cam lever 16*a* is pivoted, the support shaft 19*b* is rotated 180° forward and reverse, and therefore the first pivot arm 21 is pivoted 180°.

(3) The first pivot arm 21 is provided only at one end of the support shaft 19*b*.

(4) The first pivot arm 21 and the first linking rod 22 form a toggle mechanism. Thus, when the pivot frame 3 is in a horizontal state (see FIG. 7) and in a vertical state (see FIG. 8), the first pivot arm 21 and the first linking rods 22 are in the vertical direction; and also, the axis passing through the center of the linking portion of the first pivot arm 21 and the first linking rod 22 (linking axis $N_1$), the axis passing through the center of the linking portion of the first linking rods 22 and the pivot frame 3 (linking axis $N_2$), and the pivot axis $O_2$ are all located within a single (common) vertical plane. This structure holds the horizontal state (see FIG. 7) and vertical state (see FIG. 8) of the pivot frame 3.

(5) Upper and lower stoppers 37 and 38 that restrict the amount of pivot of the first pivot arm 21 (for 180°) are installed on one of the support portions 2*d* of the movable frame 2. The horizontal state (see FIG. 7) and vertical state (see FIG. 8) of the pivot frame 3 are assuredly held by these stoppers 37 and 38.

(6) An orientation changing cam 23 that is shared by the gripper devices is provided in a horizontal plane on the pedestal of the rotary bag filling and packaging machine. Unlike the orientation changing cam 23 shown in FIG. 1, this orientation changing cam 23 does not need to be a full peripheral (or circular) cam, and it can be provided only in a region where the orientation of the bag is changed (although, it can be a full peripheral (circular) cam). More specifically, the orientation changing cam 23, in the structure of FIGS. 7 and 8, can be provided only in the area that corresponds to the above-described areas C and D of the orientation changing cam 23 of FIG. 1. In other words, the orientation changing cam 23 of FIGS. 7 and 8 can only be provided in the area between the bag mouth opening step position and the following filling step position (see the orientation changing cam 23 shown in FIG. 7) and in the area between the filling step position and the following sealing step position. Since the orientation changing cam 23 of the gripper device of FIGS. 7 and 8 is not a full peripheral (circular) cam, it is possible to reduce wear of the first cam roller 17.

The operation of the gripper device of FIGS. 7 and 8 will be described below, focusing in particular on the operation of the orientation changing mechanism 14. FIGS. 7 and 8 are, similar to FIGS. 1 and 2, illustrated such that only the functions of the bag orientation changing mechanism 14 and the orientation changing cam 23 are focused. Although FIG. 7 shows the orientation changing cam 23 which is provided in the above-described area C (which is an area between the bag mouth opening step position and the sealing step position), an orientation changing cam provided in the above-described area D (which is an area between the filling step position and the sealing step position) is not shown in FIG. 7.

FIG. 7 shows a gripper device in which the first cam roller 17 is not in contact with the orientation changing cam 23, and the toggle mechanism (comprised of the first pivot arm 21 and the first linking rods 22) maintains the pivot frame 3 in a horizontal state, and the gripper arms 4 and 5 are opened.

In the course of the movement of the gripper device, when the first cam roller 17 comes into contact with the cam face 23*a* of the position changing cam 23 and moves (rolls) along the orientation changing cam 23, the first cam roller 17 is displaced to the inside diameter side of the predetermined path for the gripper device, and thus the first cam levers 16*a* and 16*b* are both pivoted. The support shaft 19*b* is accordingly rotated via the support shaft 19*a*, the larger-diameter gear 35, and the smaller-diameter gear 36; and as a result the first pivot arm 21 is pivoted upward (counter-clockwise in the FIG. 7). By the time the first cam roller 17 is moved away from the orientation changing cam 23, the first pivot arm 21 is pivoted 180° and comes into contact with the stopper 37 to stop its pivoting. As the first pivot arm 21 is pivoted 180° upward, the pivot frame 3 (and the pair of gripper arms 4 and 5 thereon) is pivoted 90° downward, the pivot frame 3 is changed to a vertical state, and gripper arms 4 and 5 face downward, so that the bag F held by the gripping members 12 of the gripper arms 4 and 5 is changed to a horizontal orientation (see FIG. 8). At the point when the first pivot arm 21 has pivoted 180° upward, the linking axis $N_1$, the linking axis $N_2$, and the pivot axis $O_2$ all lie in the above-described vertical plane, the holding action produced by the toggle mechanism is exerted on the first pivot arm 21 and the first linking rods 22, so that the pivot frame 3 is held stably in the vertical state.

Conversely, when the first cam roller 17 comes into contact with an orientation changing cam (not shown), and the first cam roller 17 is displaced to the outside diameter side of the predetermined path for the gripper device, the pivot frame 3 is changed from the vertical state (see FIG. 8) to a horizontal state (see FIG. 7). When the first cam roller 17 is thus displaced, the first cam levers 16*a* and 16*b* are pivoted, and the support shaft 19*b* is rotated via the support shaft 19*a*, the large-diameter gear 35, and the small-diameter gear 36; and as a result the first pivot arm 21 is pivoted 180° downward (clockwise in FIG. 8) and comes into contact with the stopper 38 to stop its pivoting (see FIG. 7). As the first pivot arm 21 is thus pivoted 180° downward, the pivot frame 3 (and the pair of gripper arms 4 and 5 thereon) is pivoted 90° upward, the pivot frame 3 is changed to a horizontal state, and the gripper arms 4 and 5 are changed to a horizontal orientation, so that the bag F held by the gripping members 12 of the gripper arms 4 and 5 is changed to a vertical orientation (see FIG. 7). At the point when the first pivot arm 21 has pivoted 180° downward, the linking axis $N_1$, the linking axis $N_2$, and the pivot axis $O_2$ all lie in the above-described vertical plane, the holding action produced by the toggle mechanism is exerted on the first pivot arm 21 and the first linking rods 22, so that the pivot frame 3 is held stably in the horizontal state.

The examples described above are those in which the gripper device of the present invention is applied to a particular rotary bag filling and packaging machine; however, the gripper device of the present invention is applicable to rotary bag filling and packaging machines in which different packaging processing is executed.

In addition, the gripper device according to the present invention is further applicable to other types of bag filling and packaging machines as described below, for example.

(1) In the above examples, the rotary bag filling and packaging machine is of a type that makes intermittent rotation; however, the gripper device according to the present invention can be applied to a rotary bag filling and packaging machine of a continuous rotation type (in which the table rotates continuously at a constant speed).

(2) In the above examples, the movable frame is fixed to the rotary table (the movable frame thus is a separate part from the rotary table); however, the rotary table itself can be constituted by a movable frame (the movable frame and the rotary table are thus integrated).

(3) The gripper device according to the present invention is applicable to a racetrack type bag filling and packaging machine as disclosed in Patent Documents 1 and 2. In such a structure, the movable frame of the gripper device is fixed to a chain or belt that is continuously or intermittently rotated along the racetrack-shaped path.

(4) The gripper device according to the present invention is further applicable to a retainer-type bag filling and packaging machine as disclosed in the Japanese Patent No. 3,681,563, for example. In this technical field, the term "retainer" means such a unit that holds and transports bags as a holder stand (10) of the Japanese Patent No. 3,681,563. Retainer-type bag filling and packaging machines are provided with a transport mechanism (which is the catching mechanism described in the Japanese Patent No. 3,681,563 or a conveyor, a robot arm, and the like) for continuously or intermittently moving a plurality of retainers along a predetermined path. In a retainer-type bag filling and packaging machine, while the retainers are moved along a predetermined path, bags are supplied to the retainers, and the bags held by the retainers are subjected to various operations of packaging process in sequence. The above-described path is of any various types, including the circular path disclosed in the Japanese Patent No. 3,681,563, and the racetrack shape path disclosed in the Japanese Patent No. 4,190,692.

The invention claimed is:

1. A gripper device provided in a bag filling and packaging machine in a plurality of numbers and moved along a predetermined path, changing an attitude of a bag, in a course of moving along the predetermined path, from a vertical orientation to a horizontal orientation or from a horizontal orientation to a vertical orientation, the gripper device comprising:

a movable frame which is moved along the predetermined path in a horizontal plane, a pivot frame pivotably supported by the movable frame and having a pivot axis which is horizontal, a pair of gripper arms provided at distal ends thereof with gripping members that hold, when closed, side edges of a bag, said gripper arms being pivotably supported by the pivot frame to open and close in conjunction with each other by being pivoted symmetrically in a plane which is parallel to the pivot axis of the pivot frame, a bag orientation changing mechanism installed in the movable frame and linked to the pivot frame, thus pivoting the pivot frame for an angle of 90 degrees, the bag orientation changing mechanism comprising:

a first cam lever pivotably supported by the movable frame with a pivot axis thereof parallel to the pivot axis of the pivot frame, a first cam roller rotatably installed at a free end of the first cam lever, the first cam roller configured to be displaced as the movable frame is moved along the predetermined path and the first cam roller in contact with a cam face of an orientation changing cam installed on a pedestal of the bag filling and packaging machine, and a first linking mechanism linking the first cam lever and the pivot frame, and a gripper arm pivot mechanism installed in the movable frame and linked to one of the gripper arms, thus pivoting the pair of gripper arms so as to adjust a reference spacing between the pair of gripper arms and open and close the pair of gripper arms.

2. The gripper device according to claim 1, wherein said first linking mechanism is comprised of:

a first pivot arm that pivots as the first cam roller is moved, and a first linking rod that is linked at one end thereof to the first pivot arm and is linked at another end thereof to the pivot frame; and the first pivot arm and the first linking rod form a toggle mechanism.

3. The gripper device according to claim 2, wherein said gripper arm pivot mechanism is comprised of:

a second cam lever that is pivotably supported by the movable frame with a pivot axis thereof lying in a plane which is horizontal and perpendicular to the pivot axis of the pivot frame, a second cam roller that is rotatably installed at a free end of the second cam lever, and a second linking mechanism that links the second cam lever and one of the gripper arms; and the second cam roller is in contact with a cam face of a gripper pivot cam installed on a pedestal of the bag filling and packaging machine, said second cam roller being displaced as the movable frame is moved along the predetermined path.

4. The gripper device according to claim 1, wherein said gripper arm pivot mechanism is comprised of:

a second cam lever that is pivotably supported by the movable frame with a pivot axis thereof being horizontal and in a plane which is perpendicular to the pivot axis of the pivot frame, a second cam roller that is rotatably installed at a free end of the second cam lever, and a second linking mechanism that links the second cam lever and one of the gripper arms; and the second cam roller is in contact with a cam face of a gripper pivot cam installed on a pedestal of the bag filling and packaging machine, said second cam roller being displaced as the movable frame is moved along the predetermined path.

5. A gripper device comprising:

a movable frame configured to move along a path;

a pivot frame coupled to the movable frame and configured to rotate about a first axis;

a bag orientation changing mechanism coupled to the movable frame and configured to rotate the pivot frame about the first axis, the bag orientation changing mechanism comprising:

a first cam lever coupled to the movable frame and configured to rotate about a second axis, the second axis substantially parallel to the first axis, a first linking mechanism coupling the first cam lever to the pivot frame, and a first cam roller coupled to the first cam lever, the first cam roller configured to:

be in contact with a face of an orientation changing cam, be displaced as the movable frame moves along the path, and cause the pivot frame to rotate about the first axis when the first cam roller is displaced;

at least two gripper arms coupled to the pivot frame and configured to rotate in a first plane, the first plane substantially parallel to the first axis, each gripper arm of the at least two gripper arms comprising a gripping member configured to hold a bag; and a gripper arm pivot mechanism coupled to the movable frame and a gripper arm of the at least two gripper arms, the gripper arm pivot mechanism configured to rotate the gripper arm such that a reference spacing between the gripping members of the at least two gripper arms is adjusted.

6. The gripper device according to claim 5, wherein:

the first linking mechanism comprises:

a first pivot arm configured to rotate as the first cam roller is displaced, and a first linking rod coupling the first pivot arm to the pivot frame.

7. The gripper device according to claim 5, wherein the gripper arm pivot mechanism comprises:

a second cam lever coupled to the movable frame and configured to rotate about a third axis, the third axis in a plane substantially orthogonal to the first axis, a second linking mechanism coupling the second cam lever to the gripper arm of the at least two gripper arms, a second cam roller coupled to the second cam lever, the second cam roller configured to:

be in contact with a face of a gripper pivot cam, be displaced as the movable frame moves along the path, and cause the reference spacing between the gripping members to adjust.

8. The gripper device according to claim 6, wherein the gripper arm pivot mechanism comprises:

a second cam lever coupled to the movable frame and configured to rotate about third axis, the third axis in a plane substantially orthogonal to the first axis, a second linking mechanism coupling the second cam lever to the gripper arm of the at least two gripper arms, a second cam roller coupled to the second cam lever, the second cam roller configured to:

be in contact with a face of a gripper pivot cam, be displaced as the movable frame moves along the path, and cause the reference spacing between the gripping members to adjust.

9. The gripper device according to claim 5, wherein:

the gripper arm pivot mechanism is configured to adjust the reference spacing based on a size of the bag provided.

10. The gripper device according to claim 5, wherein:

the gripper arm pivot mechanism is configured to adjust the reference spacing when the pivot frame is in a first position and a second position, the second position different from the first position and corresponding to a position of the pivot frame after rotation about the first axis.

11. The gripper device according to claim 5, further comprising:

at least one roller coupled to the gripping members of the at least two gripper arms and configured to be displaced; and wherein:

the gripping member comprises:

a first clamp configured to be stationary relative to the at least two gripper arms, a second clamp configured to move relative to the at least two gripper arms, the second clamp piece biased towards the first clamp piece, and the at least one roller causes the gripping member to release the bag when the at least one roller is displaced.

* * * * *